US007427240B2

(12) United States Patent
Takeuchi

(10) Patent No.: US 7,427,240 B2
(45) Date of Patent: Sep. 23, 2008

(54) SHAFT FOR GOLF CLUBS AND GOLF CLUB

(75) Inventor: Hiroyuki Takeuchi, Kobe (JP)

(73) Assignee: SRI Sports Limited, Kobe-Shi, Hyogo (JP)

( * ) Notice: Subject to any disclaimer, the term of this patent is extended or adjusted under 35 U.S.C. 154(b) by 0 days.

(21) Appl. No.: 11/783,227

(22) Filed: Apr. 6, 2007

(65) Prior Publication Data

US 2008/0004127 A1 Jan. 3, 2008

(30) Foreign Application Priority Data

Jun. 28, 2006 (JP) ..... 2006-177457

(51) Int. Cl.
*A63B 53/10* (2006.01)

(52) U.S. Cl. ..... 473/319

(58) Field of Classification Search ..... 473/316–323
See application file for complete search history.

(56) References Cited

U.S. PATENT DOCUMENTS 5,439,219 A * 8/1995 Vincent ..... 473/319
6,117,021 A * 9/2000 Crow et al. ..... 473/289
6,322,458 B1 * 11/2001 Kusumoto et al. ..... 473/316
6,485,376 B1 * 11/2002 Hisamatsu ..... 473/319
6,652,389 B2 * 11/2003 Hisamatsu et al. ..... 473/319

FOREIGN PATENT DOCUMENTS

JP 2000-254264 A * 9/2000
JP 2003-169871 A 6/2003
JP 2005-034550 A 2/2005

* cited by examiner

*Primary Examiner*—Stephen L. Blau
(74) *Attorney, Agent, or Firm*—Birch, Stewart, Kolasch & Birch, LLP

(57) ABSTRACT

Each point obtained by plotting flexural rigidity EI measured at ten sites on a shaft is defined as from T(1) to T(10) in this order from the head side, and the formula representing a line K that passes the T(1) and the T(10) is [Y=aX+b1]. The values at the Y-intercepts on the lines that are parallel to the line K and that pass the points of from T(2) to T(9), respectively, are defined as from b2 to b9, respectively, and the minimum value among the values at the Y-intercept b2 to b9 is defined as bmin. In this shaft, slope "a" of the line K is 0.04 or greater and 0.06 or less; any one of the b3, b4, b5, b6, b7 and b8 is smaller than b1; and the bmin is any one of b4 to b7. The value (b1−bmin) is 24 ($N \cdot m^2$) or greater and 35 ($N \cdot m^2$) or less, and the value (b9−b1) is 0 or greater and 10 ($N \cdot m^2$) or less. This shaft achieves excellent flight distance performance and directionality of the hit ball.

5 Claims, 6 Drawing Sheets

SHAFT FOR GOLF CLUBS AND GOLF CLUB

This application claims priority on Patent Application No. 2006-177457 filed in JAPAN on Jun. 28, 2006. The entire contents of this Japanese Patent Application are hereby incorporated by reference.

BACKGROUND OF THE INVENTION

1. Field of the Invention

The present invention relates to shafts for golf clubs and golf clubs.

2. Description of the Related Art

In recent years, carbon shafts, which are generally referred to, have been used as the shaft for golf club. In the carbon shafts, carbon fiber having high specific strength and specific rigidity is used. As the specific strength and specific rigidity of the carbon fiber increases, manufacture of lightweight shafts for golf clubs has been enabled.

During swing, the shaft is bent and twisted. Behavior of the shaft during swing may vary depending on rigidity distribution of the shaft. JP-A-2003-169871 and JP-A-2005-34550 disclose a shaft manufactured taking into consideration of the rigidity distribution. The invention described in JP-A-2003-169871 specifies rigidity at tip part of the shaft. JP-A-2005-34550 specifies a position where minimum flexural rigidity is provided.

SUMMARY OF THE INVENTION

Even in the case of the invention according to the aforementioned prior arts, satisfactory flight distance and directionality of the hit ball could not be attained. The present inventor found another technical problems potentially accompanied by the prior arts. The present invention solves such another technical problems by a technical idea which is quite different from that in the aforementioned prior arts. According to the present invention, a shaft which can improve the flight distance and the directionality of the hit ball can be provided. The present invention was made, distinct from the aforementioned prior arts, taking into consideration of the behavior the shaft during swing in detail. According to the present invention, a novel operational benefit which could not be expected conventionally can be provided.

An object of the present invention is to provide a shaft for golf clubs and a golf club that achieve excellent flight distance performance and directionality of the hit ball.

In the shaft for golf clubs according to the present invention; a position 130 mm away from the head-side end of the shaft is defined as a first position; a position 130 mm away from the grip-side end of the shaft is defined as a tenth position, and positions provided by equally dividing the length between the first position and the tenth position into nine regions are defined as from a second position to a ninth position in this order from the head side. In the shaft according to the present invention, each flexural rigidity EI measured at ten sites of from the first position to the tenth position is defined as from EI(1) to EI(10) in this order from the head side. Provided that: each point obtained by plotting the measurement values at the positions of ten sites on an X-Y coordinate plane, in which the X-axis represents the distance (mm) to the measurement position from the head-side end and the Y-axis represents the value of flexural rigidity EI($N \cdot m^2$), is defined as from T(1) to T(10) in this order from the head side; the formula representing a line K that passes the T(1) and the T(10) on the X-Y coordinate plane is [Y=aX+b1]; the values ($N \cdot m^2$) at the Y-intercepts on the lines that are parallel to the aforementioned line K and that pass the aforementioned points of from T(2) to T(9), respectively, are defined as from b2 to b9, respectively; and the minimum value among the values at the Y-intercept b2 to b9 is defined as bmin, the following definition is made.

The slope "a" of the line K is 0.04 or greater and 0.06 or less. Any one of the b3, b4, b5, b6, b7 and b8 is smaller than b1. The bmin is any one of b4, b5, b6 or b7. The value (b1−bmin) is 24 ($N \cdot m^2$) or greater and 35 ($N \cdot m^2$) or less. The value (b9−b1) is 0 or greater and 10 ($N \cdot m^2$) or less.

Preferably, provided that the minimum value among from EI(1) to EI(10) is E1, and that the maximum value among from EI(1) to EI(7) is E2, the following definition is made. E1 is EI(2), EI(3), EI(4) or EI(5). The value E1 is 16 ($N \cdot m^2$) or greater and 25 ($N \cdot m^2$) or less. The value (E2−E1) is equal to or less than 20 ($N \cdot m^2$). The value EI(10) is 60 ($N \cdot m^2$) or greater and 90 ($N \cdot m^2$) or less.

Preferably, the overall length of the shaft is equal to or greater than 43 inches. Preferably, the forward flex of the shaft is 95 mm or greater and 120 mm or less.

The shaft for golf clubs according to the present invention improves behavior of the shaft during swing. The shaft for golf clubs according to the present invention achieves excellent directionality of the hit ball and flight distance performance.

BRIEF DESCRIPTION OF THE DRAWINGS

FIG. 5 shows a developed view illustrating pre-pregs of the shaft according to Examples and the like.

DESCRIPTION OF THE PREFERRED EMBODIMENTS

Hereinafter, the present invention will be explained in detail by way of preferred embodiments with appropriate reference to the accompanying drawings.

Figure 1:
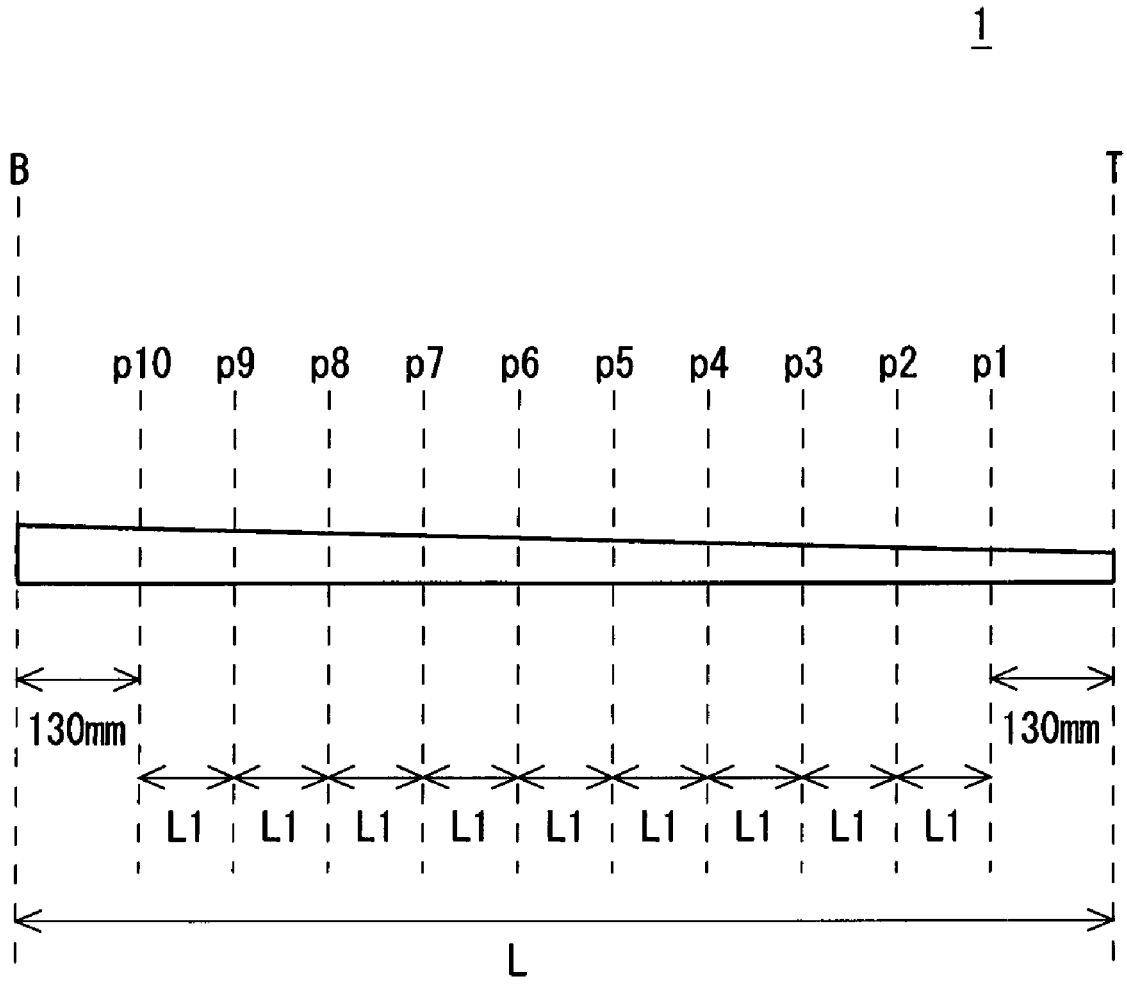
FIG. 1 shows a view for illustrating positions at which the flexural rigidity EI is measured in the shaft according to the present invention.

Shaft 1 for golf clubs has a tubular shape. As shown in FIG. 1, the shaft 1 is substantially tapered in its entirety. The shaft 1 has a head-side end T, and a grip-side end B. The head-side end T is the edge on the side having a smaller diameter. The grip-side end B is the edge on the side having a greater diameter. Although not shown in the figure, a golf club head is attached in the vicinity of the head-side end T, while a grip is attached in the vicinity of the grip-side end B. Material of the shaft 1 is not particularly limited. Typical shaft 1 may be either a carbon shaft or a steel shaft. The carbon shaft is manufactured with CFRP (carbon fiber reinforced plastic). The steel shaft is manufactured with steel.

In the present invention, flexural rigidity EI at positions of ten sites is defined. The position in the present invention referred to herein means a position along the shaft axis direction. The shaft as defined below achieves excellent flight distance performance and directionality of the hit ball. This shaft will be explained later.

As the measurement position of the flexural rigidity EI, the positions of ten sites of from the first position to the tenth position are defined. As shown in FIG. 1, the position 130 mm away from the head-side end T of the shaft 1 is the first position p1. The position 130 mm away from the grip-side end B of the shaft 1 is the tenth position p10. Positions provided by equally dividing the length between the first position p1 and the tenth position p10 into nine regions are defined as the second position p2, the third position p3, the fourth position p4, the fifth position p5, the sixth position p6, the seventh position p7, the eighth position p8 and the ninth position p9 in this order from the head side.

The positions of from the first position p1 to the tenth position p10 are arranged at even intervals along the shaft axis direction. What is indicated by L1 in FIG. 1 is the interval between adjacent positions. Provided that the shaft overall length is defined as L (mm), the interval L1 (mm) of the adjacent positions is represented by the following formula.

$$L1=(L-260)/9$$

Each flexural rigidity EI measured at ten sites of from the first position p1 to the tenth position p10 is each defined as from EI(1) to EI(10) in this order from the head side. More specifically, they may be explained as described below.

1) The flexural rigidity EI measured at the first position p1 is EI(1).

2) The flexural rigidity EI measured at the second position p2 is EI(2).

3) The flexural rigidity EI measured at the third position p3 is EI(3).

4) The flexural rigidity EI measured at the fourth position p4 is EI(4).

5) The flexural rigidity EI measured at the fifth position p5 is EI(5).

6) The flexural rigidity EI measured at the sixth position p6 is EI(6).

7) The flexural rigidity EI measured at the seventh position p7 is EI(7).

8) The flexural rigidity EI measured at the eighth position p8 is EI(8).

9) The flexural rigidity EI measured at the ninth position p9 is EI(9).

10) The flexural rigidity EI measured at the tenth position p10 is EI(10).

Figure 2:
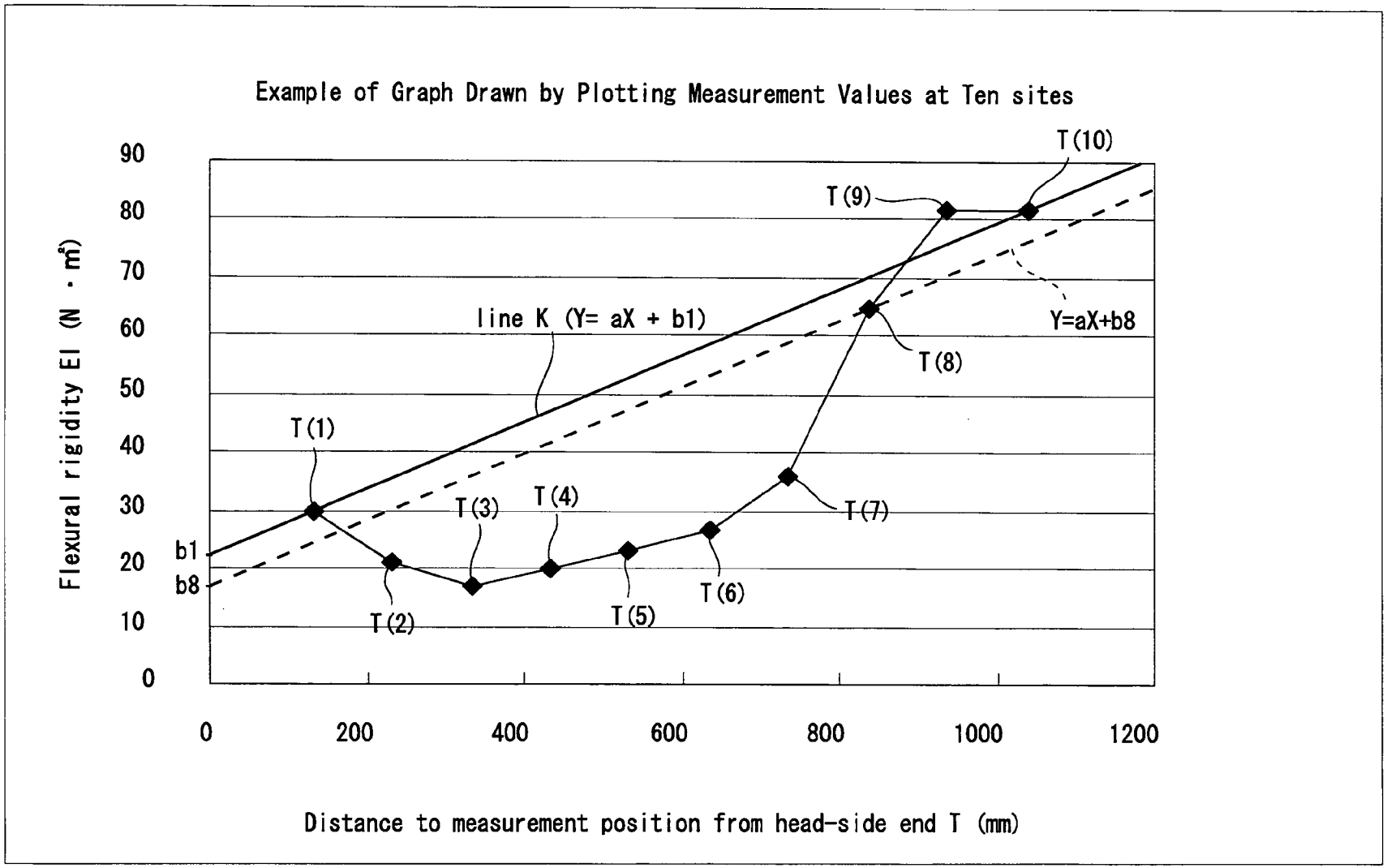
FIG. 2 shows one example of the graph drawn by plotting measurement values of flexural rigidity EI at ten sites on the X-Y coordinate plane.

On the basis of these measurement values, a graph is produced on an X-Y coordinate plane. One examples of this graph is shown in FIG. 2. In this X-Y coordinate plane, the X-axis represents the distance (mm) to the measurement position from the head-side end T. The Y-axis represents the value of flexural rigidity EI($N\cdot m^2$). Each point obtained by plotting the measurement values at the positions of ten sites on this X-Y coordinate plane is defined as from T(1) to T(10) in this order from the head side. More specifically, they may be explained as described below.

1) The X-coordinate of T(1) is 130, and the Y-coordinate of T(1) is EI(1).

2) The X-coordinate of T(2) is (L1×1+130), and the Y-coordinate of T(2) is EI(2).

3) The X-coordinate of T(3) is (L1×2+130), and the Y-coordinate of T(3) is EI(3).

4) The X-coordinate of T(4) is (L1×3+130), and the Y-coordinate of T(4) is EI(4).

5) The X-coordinate of T (5) is (L1×4+130), and the Y-coordinate of T(5) is EI(5).

6) The X-coordinate of T(6) is (L1×5+130), and the Y-coordinate of T(6) is EI(6).

7) The X-coordinate of T(7) is (L1×6+130), and the Y-coordinate of T(7) is EI(7).

8) The X-coordinate of T(8) is (L1×7+130), and the Y-coordinate of T(8) is EI(8).

9) The X-coordinate of T(9) is (L1×8+130), and the Y-coordinate of T(9) is EI(9).

10) The X-coordinate of T(10) is (L1×9+130), and the Y-coordinate of T(10) is EI(10).

On the aforementioned X-Y coordinate plane, the formula representing the line K that passes the T(1) and the T(10) on the X-Y coordinate plane is [Y=aX+b1] In other words, the slope of the line K is represented by a, and the Y-intercept ($N\cdot m^2$) of the line K is defined as b1.

The values ($N\cdot m^2$) at the Y-intercepts on the lines that are parallel to the aforementioned line K and that pass the aforementioned points of from T(2) to T(9), respectively, are defined as from b2 to b9, respectively. More specifically, they may be explained as described below.

1) T2 is a point on the line represented by the formula: [Y=aX+b2].

2) T3 is a point on the line represented by the formula: [Y=aX+b3].

3) T4 is a point on the line represented by the formula: [Y=aX+b4].

4) T5 is a point on the line represented by the formula: [Y=aX+b5].

5) T6 is a point on the line represented by the formula: [Y=aX+b6].

6) T7 is a point on the line represented by the formula: [Y=aX+b7].

7) T8 is a point on the line represented by the formula: [Y=aX+b8].

8) T9 is a point on the line represented by the formula: [Y=aX+b9].

FIG. 2 shows one example of a graph drawn by plotting the measurement values at ten sites. Solid line in FIG. 2 shows the line K described above. The broken line shows a line represented by the formula [Y=aX+b8] that passes T8, as one example of the lines that pass T2 to T9, respectively. FIG. 2 shows a graph demonstrating Example 1 described later.

The minimum value among the Y-intercept values b2 to b9 is defined as bmin. More specifically, the minimum value among b2, b3, b4, b5, b6, b7, b8 and b9 is the bmin.

In the shaft 1 defined as in the foregoing, the slope "a" of the line K is preferably equal to or greater than 0.04, and more preferably equal to or greater than 0.05. The slope "a" of the line K is preferably equal to or less than 0.06. Every one of the b3, b4, b5, b6, b7 and b8 described above is preferably smaller than b1. It is preferred that the aforementioned bmin be any one of b4, b5, b6 or b7. It is preferred that (b1−bmin) is 24 ($N\cdot m^2$) or greater and 35 ($N\cdot m^2$) or less. In addition, it is preferred that (b9−b1) is 0 or greater and 10 ($N\cdot m^2$) or less.

Next, operational advantages of such shaft 1, and the shaft behavior to be the premise thereof will be explained.

In the golf club, a head is attached at the head-side end T of the shaft. This head has a comparably great weight. Resulting from inertia and the like of this head, the shaft behavior during swing will be as described below.

When the swing is initiated, i.e., in the beginning of raising (taking back), the shaft is bent in the direction to give the head side getting behind. Due to the counteraction thereof, the shaft is bent so that the head side precedes in the raised direction after completing the raising. Such bending is further increased in the beginning of the downward swing (downswing). More specifically, in the beginning of the downward swing, the shaft is bent in the direction to give the head side getting behind with respect to the direction of the downward swing. Due to the counteraction of such bending, the shaft tends to be bent so that the head side precedes in the swinging direction during the time period of from initiation of the downward swing to the impact. This behavior of the shaft affects the head speed upon impact. By recovery of the bending of the shaft from the state in which the head side is getting behind to the state in which the head side is not getting behind, the head speed upon impact can be accelerated.

Accordingly, the head speed Si upon impact shall be total speed of the swing speed S1 of the entire shaft, and the head speed S2 resulting from the bending. In other words, they follow a relationship represented by the formula [Si=S1+S2]. The swing speed S1 is defined as the head speed resulting from the movement of the entire shaft.

The head speed S2 may vary depending on the state of the shaft upon impact. The head speed S2 may vary depending on the bending behavior of the shaft, and timing of the impact. When the shaft behavior and the timing of the impact are unsatisfactory, the head speed S2 may present a minus value. Recovery of the bending can lead to either acceleration of the head, or deceleration thereof. When the impact is executed in the state in which the shaft is bent to give the head side getting behind, acceleration resulting from the bending cannot be sufficiently achieved, whereby the head speed S2 is lowered. In the case in which the impact is executed at the moment when the bending in the direction to give the head side getting behind recovers, the head speed S2 can reach to the maximum. In other words, the head speed S2 can be maximized by substantial coincidence of the moment at which the bending in the direction to give the head side getting behind recovers to the state of the shaft being almost straight, and the moment of the impact. By maximizing the head speed S2, the head speed Si upon impact can be maximized.

In order to increase the head speed S2 resulting from the bending of the shaft, it is necessary to increase the bending of the shaft during swing. In order to increase the bending of the shaft during swing, it is desired that flexural rigidity EI of the shaft in its intermediate part is decreased. However, when the flexural rigidity EI of the shaft in its intermediate part is merely decreased, the impact tends to be executed while keeping the state in which the head side of the shaft is getting behind. This tendency is noticeably found in beginners among the golf players, in particular. In order to correct this tendency, increase in the flexural rigidity EI on the grip side of the shaft is effective. More specifically, by decreasing flexural rigidity EI in the intermediate part and increasing flexural rigidity EI on the grip side, the bending in the direction to give the head getting behind is increased, and the impact can be executed at the moment when this bending is almost abolished.

The bending of the shaft at the impact may affect the directionality of the hit ball because the orientation of the face at impact can vary depending on the bending of the shaft upon impact. For example, the bending in the direction to give the head side getting behind makes it easy to cause an open face. Due to the open face, a slice of the hit ball is liable to be caused. To the contrary, the bending in the direction to give the head side being preceded makes it easy to cause a closed face. Due to the closed face, a hook of the hit ball is liable to be caused. Impact in the state in which the bending of the shaft is almost abolished can improve the directionality of the hit ball.

The bending of the shaft upon impact may also affect the launch angle. The bending in the direction to give the head side getting behind can reduce the loft angle at impact. When the loft angle at impact is small, the launch angle may be reduced, thereby achieving lower hit ball. The impact in the state in which the bending of the shaft is almost abolished can increase the loft angle at impact as compared with the impact in the state of the head side getting behind. The increase in the loft angle at impact may increase the launch angle. Increase in the launch angle can be responsible for increase in the flight distance.

In light of increase in the head speed S2 through increasing the bending of the shaft in the beginning of the downward swing, it is preferred that any one of the b3, b4, b5, b6, b7 and b8 is smaller than b1. In light of increase in the head speed S2 through increasing the bending of the shaft in the beginning of the downward swing, it is preferred that the bmin is any one of b4, b5, b6 or b7, and is more preferred that bmin is b5 or b6.

In light of increase in the head speed S2 through increasing the bending of the shaft in the beginning of the downward swing, (b1−bmin) is preferably equal to or greater than 24 ($N\cdot m^2$), more preferably equal to or greater than 25 ($N\cdot m^2$), and particularly preferably 26 ($N\cdot m^2$). In light of preventing the impact from being executed before perfect recovery of the bending of the shaft, (b1−bmin) is preferably equal to or less than 35 ($N\cdot m^2$), more preferably equal to or less than 34 ($N\cdot m^2$), and particularly preferably equal to or less than 33 ($N\cdot m^2$).

The value (b9−b1) correlates with likelihood of recovery of the bent shaft. As the value (b9−b1) is greater, the bending tends to recover. In light of optimization of the recovery of the bending, and inhibition of the impact in the state with the head getting behind, (b9−b1) is preferably equal to or greater than 0 ($N\cdot m^2$), more preferably equal to or greater than 1 ($N\cdot m^2$), and particularly preferably equal to or greater than 2 ($N\cdot m^2$). When the bending recovers excessively, the impact in the state in which the head precedes is liable to be executed. In light of inhibition of the impact in the state in which the head precedes, and suppression of a hook, (b9−b1) is preferably equal to or less than 10 ($N\cdot m^2$), more preferably equal to or less than 9 ($N\cdot m^2$), and particularly preferably equal to or less than 8 ($N\cdot m^2$).

In light of improvement of the feel at impact and timing of hitting the ball while making the middle part of the shaft soft, it is necessary to make the shaft rear end harder than the shaft tip part. In light of improvement of the feel at impact and timing of hitting the ball, the slope "a" of the line K is preferably equal to or greater than 0.04, and more preferably equal to or greater than 0.05. In light of preventing the feel at impact from becoming too hard, the slope "a" of the like K is preferably equal to or less than 0.06.

Herein, the minimum value of from EI(1) to EI(10) is defined as E1, and the maximum value of from EI(1) to EI(7) is defined as E2. In light of making the middle part of the shaft soft to increase the head speed S2, E1 is preferably EI(2), EI(3), EI(4) or EI(5).

In light of suppression of excessive bending in the beginning of the downward swing, thereby preventing the impact from being executed before perfect recovery of the bending, E1 is preferably equal to or greater than 16 ($N\cdot m^2$), more preferably equal to or greater than 17 ($N\cdot m^2$), and particularly preferably equal to or greater than 18 ($N\cdot m^2$). In light of increase in the head speed S2 through increasing the bending of the shaft in the beginning of the downward swing, E1 is preferably equal to or less than 25 ($N\cdot m^2$), more preferably equal to or less than 24 ($N\cdot m^2$), and particularly preferably equal to or less than 23 ($N\cdot m^2$).

In light of optimization of the bending behavior of the shaft and the timing of the impact, accompanied by optimization of the extent of bending of the shaft, lower limit of (E2−E1) is preferably equal to or greater than 12 ($N \cdot m^2$), more preferably equal to or greater than 15 ($N \cdot m^2$), while upper limit of (E2−E1) is preferably equal to or less than 23 ($N \cdot m^2$), more preferably equal to or less than 20 ($N \cdot m^2$), and particularly preferably equal to or less than 19 ($N \cdot m^2$).

In light of making the recovery of the bending optimum, and inhibition of the impact in the state with the head getting behind, EI(10) is preferably equal to or greater than 60 ($N \cdot m^2$). In light of inhibition of the impact in the state in which the head precedes, and suppression of a hook, EI(10) is preferably equal to or less than 90 ($N \cdot m^2$).

As the weight of the shaft is reduced, the amount of the carbon fiber in use tends to be decreased. For example, in the case of the shafts manufactured by a sheet winding method, lightweight can be achieved by reducing the mass per unit area of the pre-preg. By reducing the amount of the carbon fiber, shaft flex can be softened, while the torque can be increased.

The weight of the golf clubs tends to be reduced by reducing the weight of the head in addition to the shaft. Owing to the lightweight golf club, the head speed is apt to be increased. When a soft shaft is swung at a high head speed, there may be the case in which the shaft is excessively bent in the beginning of the downward swing. The impact executed before perfect recovery of the bending is not preferred as described above. Therefore, the present invention is particularly advantageous in comparatively lightweight shafts. Also, when the shaft is too heavy, operativity as a golf club may be deteriorated. In this respect, the shaft weight is preferably equal to or less than 70 g, more preferably equal to or less than 68 g, and particularly preferably equal to or less than 66 g based on the converted value in the length of 1169 mm. In light of increase in strength of the shaft, and optimization of the forward flex, the shaft weight is preferably equal to or greater than 40 g, more preferably equal to or greater than 50 g, still more preferably equal to or greater than 52 g, and particularly preferably equal to or greater than 54 g based on the converted value in the length of 1169 mm. The converted value W1 (g) in the length of 1169 mm of the shaft having an overall length of L (mm) and a weight of W (g) is calculated by the following formula:

$$W1 = W \times 1169/L.$$

The present invention is relevant to the bending of shafts, and recovery of the bending. As the shaft overall length L is greater, influence of the bending becomes greater. As the shaft overall length L is greater, the advantage of the present invention is likely to be more explicit. In this respect, the shaft overall length L is preferably equal to or greater than 41 inches (1041 mm), more preferably equal to or greater than 43 inches (1092 mm), still more preferably equal to or greater than 44 inches (1117 mm), and particularly preferably equal to or greater than 45 inches (1143 mm). In light of assurance of the strength of the shaft, the shaft overall length L is preferably equal to or less than 52 inches (1321 mm), more preferably equal to or less than 50 inches (1270 mm), and particularly preferably equal to or less than 48 inches (1219 mm).

In light of avoiding too soft feeling, and inhibition of the impact in the state with the head getting behind, the shaft has a forward flex f of preferably equal to or greater than 95 mm, more preferably equal to or greater than 96 mm, and particularly preferably equal to or greater than 97 mm. In light of increase in the head speed S2 resulting from the bending of the shaft while avoiding too hard feeling, the forward flex f is preferably equal to or less than 120 mm, more preferably equal to or less than 119 mm, and particularly preferably equal to or less than 118 mm.

Method of manufacturing the shaft is not particularly limited. As described in the foregoing, the shaft may be either so called steel shaft, or carbon shaft. In light of design freedom in connection with the flexural rigidity EI, carbon shafts are preferred. Examples of the method of manufacturing the carbon shaft which can be employed include sheet winding methods, filament winding methods and the like. In light of the design freedom in connection with the flexural rigidity EI and lightweight, the sheet winding methods are preferred. CFRP (carbon fiber reinforced plastic) which can be used for the carbon shaft may be obtained by impregnating strengthening fiber consisting of carbon fiber in an epoxy resin. Examples of the matrix resin which can be used include thermosetting resins, thermoplastic resins and the other then epoxy resins, in addition to the epoxy resins.

EXAMPLES

Hereinafter, advantages of the present invention will be clarified by way of Examples, however, the present invention should not be construed as being limited based on the description of the Examples.

Measurement processes are as in the following.

[Process for Measuring Flexural Rigidity EI]

Figure 3:
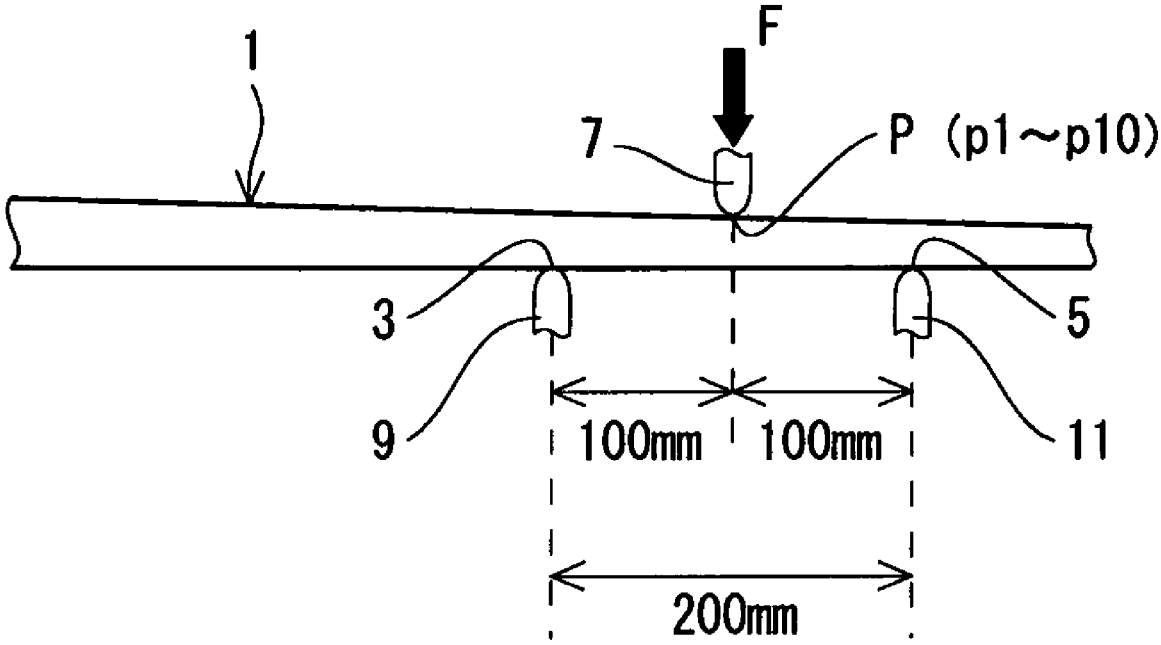
FIG. 3 shows an explanatory view for illustrating a process for measuring the flexural rigidity EI.

FIG. 3 shows an explanatory view for illustrating a process for measuring the flexural rigidity EI. The flexural rigidity EI was measured using type 2020 manufactured by INTESCO Co., Ltd. (maximum load: 500 kg). As shown in FIG. 3, deflection α was measured when a load F was applied to the measurement point P from above while supporting shaft 1 at two supporting points 3 and 5. The measurement point P may be any one of from p1 to p10 described above. Distance (span) between the supporting point 3 and the supporting point 5 was 200 mm. The measurement point P was located at a point provided by equally dividing the length between the supporting point 3 and the supporting point 5. Tip of the indentor 7 that applies the load F from above is rounded. Cross-sectional shape of the tip of the indentor 7 has a curvature radius of 10 mm in the cross section which is parallel to the shaft axis direction. In the cross section which is perpendicular to the shaft axis direction, the cross-sectional shape of the tip of the indentor 7 has a linear shape, and the length thereof is 45 mm.

By support 9, the shaft 1 is supported from below at the supporting point 3. The tip of the support 9 has a protruded round shape. Cross-sectional shape of the tip of the support 9 has a curvature radius of 15 mm in the cross section which is parallel to the shaft axis direction. In the cross section which is perpendicular to the shaft axis direction, the cross-sectional shape of the tip of the support 9 has a linear shape, and the length thereof is 50 mm. Support 11 has a shape that is the same as the support 9. By the support 11, the shaft 1 is supported from below at the supporting point 5. The tip of the support 11 has a protruded round shape. Cross-sectional shape of the tip of the support 11 has a curvature radius of 15 mm in the cross section which is parallel to the shaft axis direction. In the cross section which is perpendicular to the shaft axis direction, the cross-sectional shape of the tip of the support 11 has a linear shape, and the length thereof is 50 mm.

The indentor 7 was moved downward at a rate of 5 mm/min while fixing the support 9 and the support 11. When the load F reached to 20 kg, the movement of the indentor 7 was terminated. Deflection α (mm) of the shaft 1 at a moment when the movement of the indentor 7 was terminated was measured. The flexural rigidity EI(N·m$^2$) was calculated according to the following formula.

$$EI(N \cdot m^2)=32.7/\alpha$$

[Measurement of Forward Flex f]

Figure 4A:
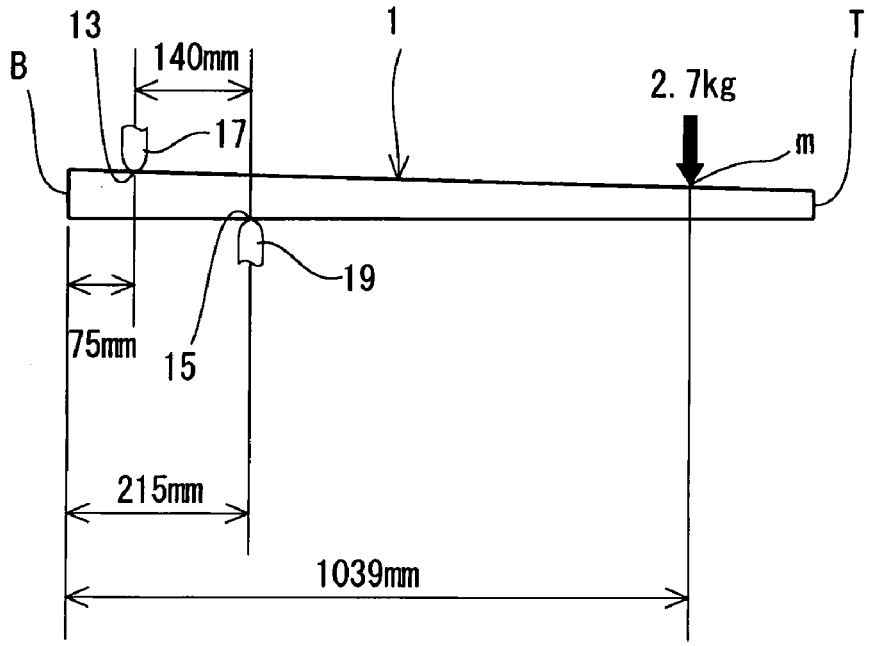
FIG. 4A shows an explanatory view for illustrating a process for measuring forward flex f.

FIG. 4A shows an explanatory view for illustrating a process for measuring forward flex f. As shown in FIG. 4A, first supporting point 13 was set at a position 75 mm away from the grip-side end B. Further, the second supporting point 15 was set at a position 215 mm away from the grip-side end B. At the first supporting point 13 was provided a support 17 that supported the shaft 1 from above. At the second supporting point 15 was provided a support 19 that supported the shaft 1 from below. In the state in which there is no load, the shaft axis line of the shaft 1 was substantially horizontal. At a weight point m that is positioned 1039 mm away from the grip-side end B, a load of 2.7 kg was allowed to act in a vertical downward direction. A travel distance (mm) to the weight point m from the state in which there was no load to the state in which a load was applied was determined as the forward flex f. This travel distance is a distance of the movement along the vertical direction.

Cross-sectional shape of a part of the support 17 to be brought into contact with the shaft (hereinafter, referred to as contact part) is as in the following. In a cross section that is parallel to the shaft axis direction, cross-sectional shape of the contact part of the support 17 has a protruded round shape. Curvature radius of this roundness is 15 mm. In a cross section that is perpendicular to the shaft axis direction, cross-sectional shape of the contact part of the support 17 has a recessed round shape. Curvature radius of this roundness is 40 mm. In a cross section that is perpendicular to the shaft axis direction, the length of the contact part of the support 17 in the horizontal direction (length in the depth direction in FIG. 4) is 15 mm. Cross-sectional shape of the contact part of the support 19 is the same as that of the support 17. Cross-sectional shape of the contact part of the load indentor (not shown in the Figure) that imparts a load of 2.7 kg at the point m has a protruded roundness in the cross section that is parallel to the shaft axis direction. The curvature radius of this roundness is 10 mm. Cross-sectional shape of the contact part of the load indentor (not shown in the Figure) that imparts a load of 2.7 kg at the point m is linear in the cross section that is perpendicular to the shaft axis direction. This line has a length of 18 mm. Accordingly, the forward flex f was measured.

Example 1

Figure 5:
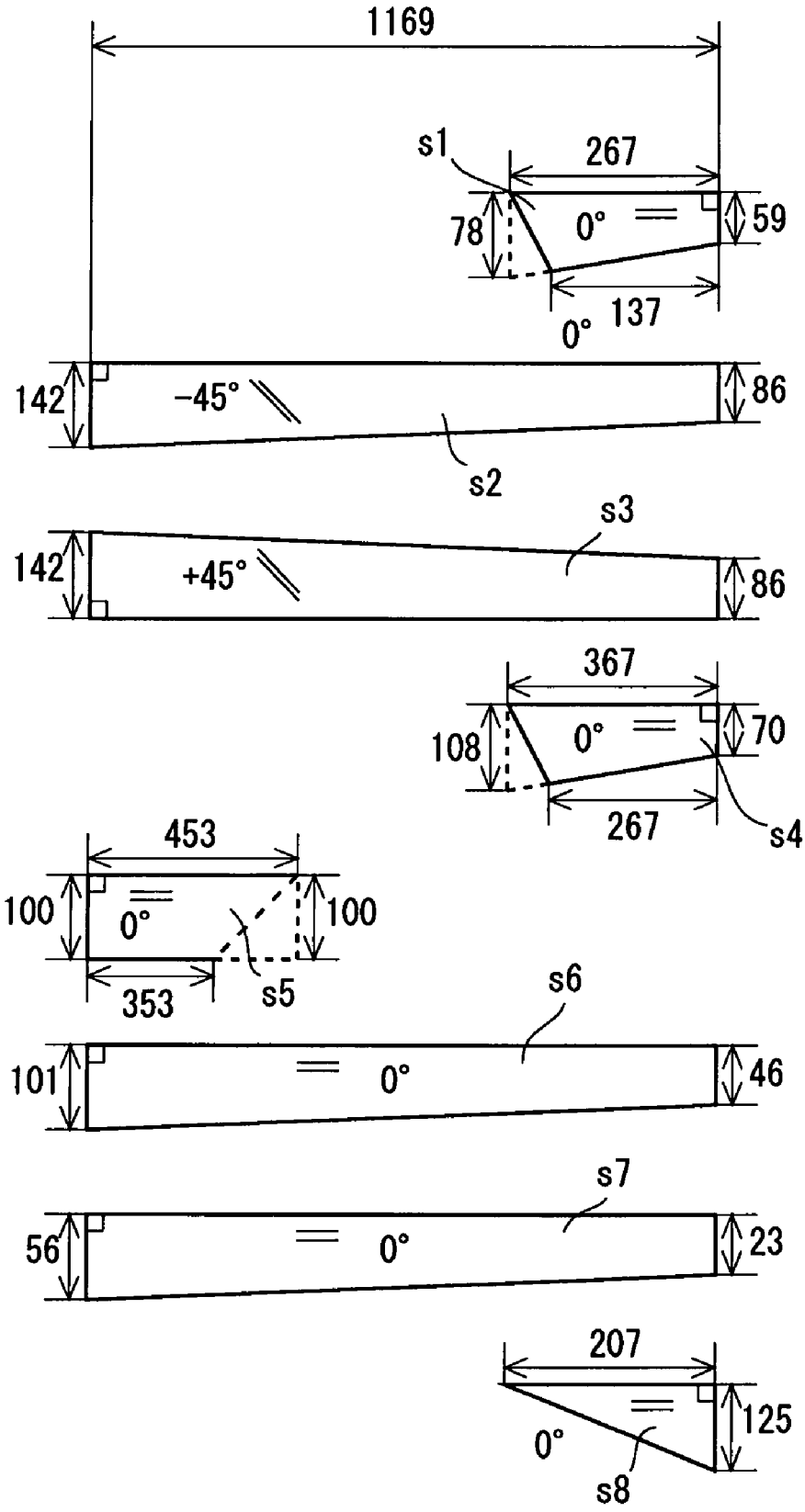

A shaft was manufactured according to a sheet winding method. Multiple pieces of the pre-preg were laminated on a mandrel made of metal by wrapping them. A developed view of thus laminated pre-pregs is shown in FIG. 5. Eight pre-pregs of from pre-preg s1, pre-preg s2, to pre-preg s8 were wrapped in this order on the mandrel not shown in the figure. The pre-pregs shown on the upper side in FIG. 5 are laminated on the inner side.

The pre-preg s1 forms a layer that reinforces the tip part. In the pre-preg s1, fiber orientation angle is substantially 0 degree with respect to the shaft axis line. In other words, the pre-preg s1 constructs a straight layer. The pre-preg s2 is provided along the overall length of the shaft. The pre-preg s2 forms a so called bias layer. In the pre-preg s2, the fiber orientation angle is substantially −45 degree with respect to the shaft axis line. The pre-preg s3 is also provided along the overall length of the shaft. The pre-preg s3 forms a so called bias layer. In the pre-preg s3, the fiber orientation angle is substantially +45 degree with respect to the shaft axis line. The pre-preg s3 and the pre-preg s4 are overlaid with each other, and wrapped in such a state. When the pre-preg s3 and the pre-preg s4 are overlaid, the pre-preg s3 is turned inside out from the state shown in FIG. 5. By thus turning inside out, the fiber orientation angles of the pre-preg s2 and the pre-preg s3 are provided in different directions one another. The pre-preg s4 forms a reinforcing layer that reinforces the tip part. In the pre-preg s4, the fiber orientation angle is substantially 0 degree with respect to the shaft axis line. In other words, the pre-preg s4 constructs a straight layer. The pre-preg s5 forms a layer that reinforces the rear end. In the pre-preg s5, the fiber orientation angle is substantially 0 degree with respect to the shaft axis line. In other words, the pre-preg s5 constructs a straight layer. The pre-preg s6 is provided along the overall length of the shaft. In the pre-preg s6, the fiber orientation angle is substantially 0 degree with respect to the shaft axis line. In other words, the pre-preg s6 constructs a straight layer. The pre-preg s7 is provided along the overall length of the shaft. In the pre-preg s7, the fiber orientation angle is substantially 0 degree with respect to the shaft axis line. In other words, the pre-preg s7 constructs a straight layer. The pre-preg s8 forms a reinforcing layer that reinforces the tip part. In the pre-preg s8, the fiber orientation angle is substantially 0 degree with respect to the shaft axis line. In other words, the pre-preg s8 constructs the straight layer. Size of each pre-preg s1 to s8 is as shown in FIG. 5. This size is represented by a unit of mm.

Brand names (product name) of the pre-pregs used for the pre-preg s1 to pre-preg s8, and modulus of elasticity of the carbon fiber are shown in the following Table 1. Any of the brand names shown in Table 1 is that of the pre-preg manufactured by Toray Industries, Inc. Number such as "−7" added at the end of the trade name of the pre-pregs indicates the index of thickness of the pre-preg. Specifically, "−7" indicates that the thickness is 0.0570 mm.; "−10" indicates that the thickness is 0.0840 mm; "−11" indicates that the thickness is 0.0820 mm; "−12" indicates that the thickness is 0.1030 mm; and "−15" indicates that the thickness is 0.1450 mm. For example, "3255G-12" indicates that the used carbon fiber has a tensile modulus of elasticity of 24 t/mm$^2$, and a thickness of 0.1030 mm. In all brands shown in Table 1, the matrix resin is an epoxy resin.

A polypropylene tape was wrapped on the external side of thus laminated pre-pregs s1 to s8. It was then heated and compressed in an oven to allow the resin to be molded while curing. From the molded product taken out from the oven, the mandrel was pulled out. Both ends were cut in order to make the length uniform, followed by carrying out the surface grinding to obtain the shaft according to Example 1. To this shaft were attached a head and a grip, whereby the golf club according to the shaft 1 was obtained. As the head, "SRIXON W-505, loft: 10.5 degree" manufactured by SRI Sports, Inc. was used.

Example 2

Shaft and golf club according to Example 2 were obtained in a similar manner to Example 1 except that brands and constructions of the pre-pregs s1 to s8 were as shown in Table 1.

[Comparative Examples 1 to 3]

Shaft and golf club according to Comparative Examples 1 to 3 were obtained in a similar manner to Example 1 except that brands and constructions of the pre-pregs s1 to s8 were as shown in Table 1. In Comparative Example 2, the pre-preg s4, the pre-preg s5 and the pre-preg s8 were not used.

Figure 4B:
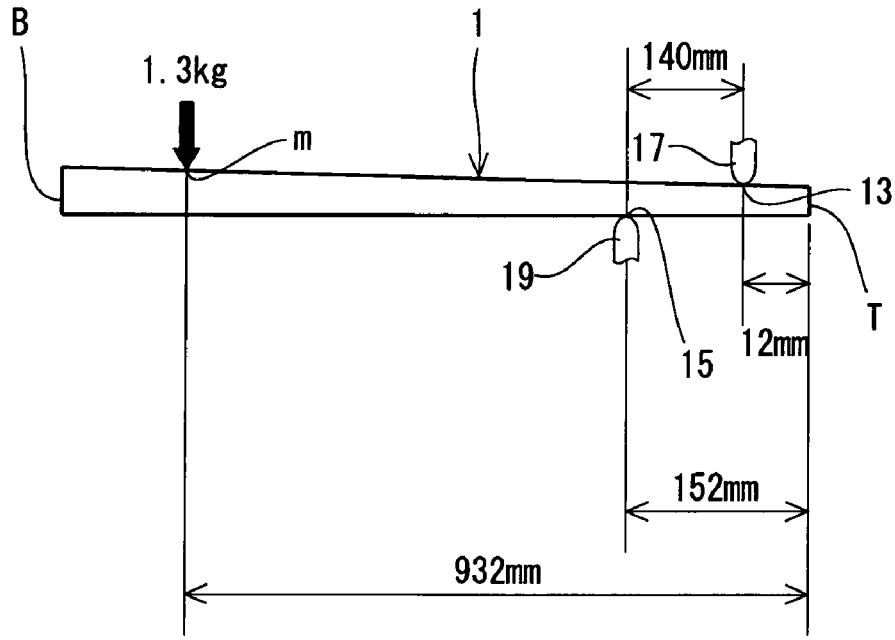
FIG. 4B shows a view for illustrating a process for measuring backward flex.

Specification in Examples and Comparative Examples, and results of evaluation thereof are shown in the following Table 2 to Table 4. The process for measuring the flexural rigidity EI was as described above. The process for measuring the forward flex f was as described above. The process for measuring the backward flex was similar to that of the forward flex f except that: the first supporting point 13 is positioned 12 mm away from the head-side end T; the second supporting point 15 is positioned 152 mm away from the head-side end T; the weight point m is positioned 932 mm away from the head-side end T, and the load was set to be 1.3 kg. The process for measuring the backward flex is shown in FIG. 4B.

Figure 6:
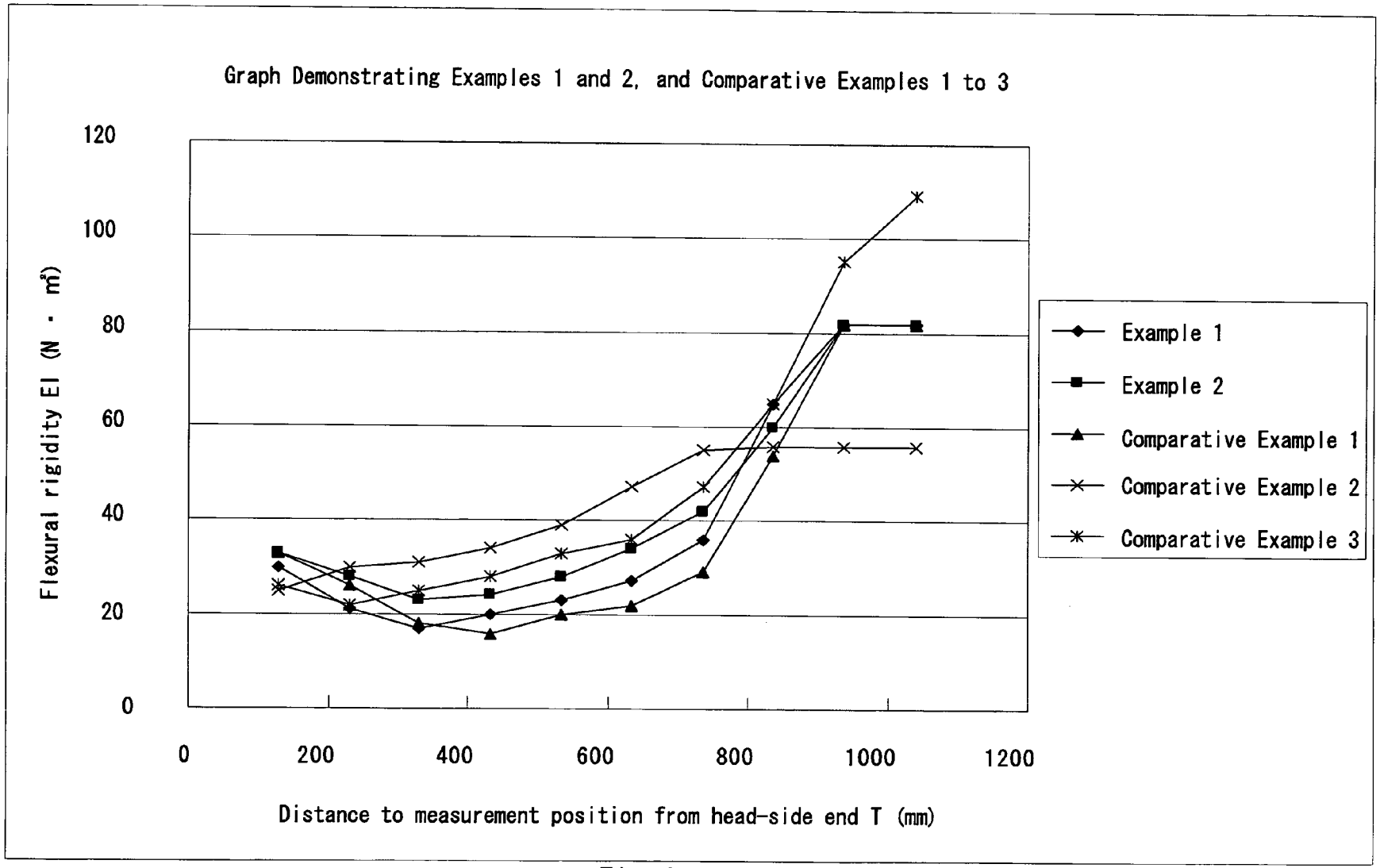
FIG. 6 shows a graph demonstrating Examples 1 and 2, and Comparative Examples 1 to 3.

FIG. 6 shows line graphs drawn by plotting from T1 to T10 and connecting them in Examples 1 and 2, and Comparative Examples 1 to 3, respectively.

Results of evaluation through actually hitting the balls will be explained below. As shown in Table 2, four items of the evaluation by the actual hitting are: "head speed", "launch angle", "flight distance", and "feeling".

Twenty testers hit 10 golf balls by each golf club, and all these data were averaged to obtain the data of the "head speed", the "launch angle", the "flight distance", and the "feeling". Handicap of the twenty testers is in the range of 20 or greater and 35 or less. These data are shown in the following Table 2. The golf ball used was commercially available three-piece ball, "HI-BRID Everio" ® manufactured by SRI Sports, Inc. The "flight distance" was a distance in the direction between the position where the ball was hit and the target position. Each tester gave the evaluation scores according to the following criteria, and average of evaluation scores by ten golf players was determined as the evaluation value of the "feeling". As the evaluation value is closer to the score 3, more favorable result is suggested.

1) Feeling of the shaft being extremely hard: score 1;
2) feeling of the shaft being somewhat hard: score 2;
3) hardness of the shaft being desirable: score 3;
4) feeling of the shaft being somewhat soft: score 4; and
5) feeling of the shaft being extremely soft: score 5.

TABLE 1

Brand of pre-preg used in Examples and Comparative Examples

| | | Example 1 | Example 2 | Comparative Example 1 | Comparative Example 2 | Comparative Example 3 |
|---|---|---|---|---|---|---|
| s1 | Fiber modulus of elasticity | 24t | 24t | 24t | 24t | 24t |
| | Brand name | 3255G-12 | 3255G-12 | 3255G-12 | 3255G-12 | 3255G-12 |
| s2 | Fiber modulus of elasticity | 40t | 30t | 30t | 30t | 40t |
| | Brand name | 9255G-7 | 2255F-10 | 2255F-10 | 2255F-10 | 9255G-7 |
| s3 | Fiber modulus of elasticity | 40t | 30t | 30t | 30t | 40t |
| | Brand name | 9255G-7 | 2255F-10 | 2255F-10 | 2255F-10 | 9255G-7 |
| s4 | Fiber modulus of elasticity | 24t | 24t | 30t | Absent | 24t |
| | Brand name | 3255G-10 | 3255G-10 | 2255F-15 | | 3255G-10 |
| s5 | Fiber modulus of elasticity | 40t | 40t | 40t | Absent | 50t |
| | Brand name | 9255G-11 | 9255G-11 | 9255G-11 | | 11055F-11 |
| s6 | Fiber modulus of elasticity | 30t | 24t | 24t | 30t | 30t |
| | Brand name | 2255F-12 | 3255G-15 | 3255G-12 | 2255F-15 | 2255F-15 |
| s7 | Fiber modulus of elasticity | 30t | 30t | 24t | 30t | 24t |
| | Brand name | 2255F-10 | 2255F-15 | 3255G-12 | 2255F-15 | 3255G-15 |
| s8 | Fiber modulus of elasticity | 24t | 24t | 24t | Absent | 24t |
| | Brand name | 3255G-12 | 3255G-12 | 3255G-12 | | 3255G-10 |

TABLE 2

Specification and Results of Evaluation of Examples and Comparative Examples

| | | | | | Results of actual hitting | | | |
|---|---|---|---|---|---|---|---|---|
| | Shaft overall length L mm | Weight g | Forward flex f mm | Backward flex mm | Head speed m/s | Launch angle deg | Flight distance yards | Feeling |
| Example 1 | 1169 | 59 | 107 | 98 | 45.0 | 13.8 | 235 | 3.2 |
| Example 2 | 1169 | 69 | 107 | 89 | 44.5 | 13.5 | 230 | 3.0 |
| Comparative Example 1 | 1169 | 63 | 125 | 81 | 44.1 | 13.0 | 225 | 4.2 |
| Comparative Example 2 | 1169 | 67 | 91 | 88 | 42.9 | 12.5 | 220 | 2.2 |
| Comparative Example 3 | 1169 | 68 | 95 | 92 | 43.3 | 12.9 | 223 | 2.3 |

TABLE 3

Specification and Results of Evaluation of Examples and Comparative Examples

| | E.I. | | | | | | | | | | | | |
|---|---|---|---|---|---|---|---|---|---|---|---|---|---|
| | EI(1) N · m² | EI(2) N · m² | EI(3) N · m² | EI(4) N · m² | EI(5) N · m² | EI(6) N · m² | EI(7) N · m² | EI(8) N · m² | EI(9) N · m² | EI(10) N · m² | E1 N · m² | E2 N · m² | E2 − E1 N · m² |
| Measurement position (Distance from head-side end T) | 130 | 231 | 332 | 433 | 534 | 635 | 736 | 837 | 938 | 1039 | — | — | — |
| Example 1 | 30 | 21 | 17 | 20 | 23 | 27 | 36 | 65 | 82 | 82 | 17 | 36 | 19 |
| Example 2 | 33 | 28 | 23 | 24 | 28 | 34 | 42 | 60 | 82 | 82 | 23 | 42 | 19 |
| Comparative Example 1 | 33 | 26 | 18 | 16 | 20 | 22 | 29 | 54 | 82 | 82 | 16 | 33 | 17 |
| Comparative Example 2 | 25 | 30 | 31 | 34 | 39 | 47 | 55 | 56 | 56 | 56 | 25 | 55 | 30 |
| Comparative Example 3 | 26 | 22 | 25 | 28 | 33 | 36 | 47 | 65 | 95 | 109 | 22 | 47 | 25 |

TABLE 4

Specification and Results of Evaluation of Examples and Comparative Examples

| | Straight-line formula | | | | | | | | | | | |
|---|---|---|---|---|---|---|---|---|---|---|---|---|
| | | Intercept | | | | | | | | | | |
| | Slope a | b1 | b2 | b3 | b4 | b5 | b6 | b7 | b8 | b9 | b9 − b1 | b1 − bmin |
| Example 1 | 0.058 | 22.19 | 8.09 | −1.80 | −5.01 | −7.44 | −9.62 | −5.86 | 17.41 | 27.96 | 5.77 | 31.81 |
| Example 2 | 0.054 | 25.59 | 15.68 | 4.79 | 0.12 | −0.65 | −0.65 | 2.07 | 14.70 | 31.03 | 5.44 | 26.24 |
| Comparative Example 1 | 0.054 | 25.59 | 13.28 | 0.44 | −6.97 | −8.93 | −12.70 | −10.69 | 9.26 | 31.03 | 5.44 | 38.29 |
| Comparative Example 2 | 0.035 | 20.29 | 22.06 | 19.27 | 18.46 | 20.12 | 24.63 | 29.83 | 27.29 | 23.79 | 3.50 | 1.83 |
| Comparative | 0.092 | 14.34 | 1.26 | −5.57 | −11.40 | −16.01 | −22.22 | −20.36 | −10.86 | 9.91 | −4.43 | 36.56 |

As shown in Tables, more favorable evaluation was made on Examples as compared to Comparative Examples. According to Examples 1 and 2, improved head speed could be attained because the shaft was soft at its middle part. According to Comparative Example 1, the head speed was lower than that of Examples, and the launch angle was also low because the shaft was too soft at its middle part. In Comparative Examples 2 and 3, the middle part was hard, whereby low head speed was attained. Accordingly, advantages of the present invention are clearly indicated by these results of evaluation.

The present invention is applicable to all types of golf clubs such as wood golf clubs, iron golf clubs and the like, and shafts thereof.

The description hereinabove is merely for an illustrative example, and various modifications can be made in the scope not to depart from the principles of the present invention.

What is claimed is:

1. A shaft for golf clubs wherein provided that:

a position 130 mm away from the head-side end of the shaft is defined as a first position; a position 130 mm away from the grip-side end of the shaft is defined as a tenth position, and positions provided by equally dividing the length between the first position and the tenth position into nine regions are defined as from a second position to a ninth position in this order from the head side;

each flexural rigidity EI measured at ten sites of from the first position to the tenth position is defined as from EI(1) to EI(10) in this order from the head side;

each point obtained by plotting the measurement values at the positions of ten sites on an X-Y coordinate plane, in which the X-axis represents the distance (mm) to the measurement position from the head-side end and the Y-axis represents the value of flexural rigidity EI(N·m²), is defined as from T(1) to T(10) in this order from the head side;

the formula representing a line K that passes the T(1) and the T(10) on the X-Y coordinate plane is [Y=aX+b1];

the values (N·m²) at the Y-intercepts on the lines that are parallel to the line K and that pass the points of from T(2) to T(9), respectively, are defined as from b2 to b9, respectively; and that the minimum value among the values at the Y-intercept b2 to b9 is defined as bmin, the following definition is made, the slope "a" of the line K is 0.04 or greater and 0.06 or less, any one of the b3, b4, b5, b6, b7 and b8 is smaller than b1, the bmin is any one of b4, b5, b6 or b7, the value (b1−bmin) is 24 (N·m²) or greater and 35 (N·m²) or less, and the value (b9−b1) is 0 or greater and 10 (N·m²) or less.

2. The shaft for golf clubs according to claim 1 wherein provided that the minimum value among from EI(1) to EI(10) is E1, and that the maximum value among from EI(1) to EI(7) is E2, E1 is EI(2), EI(3), EI(4) or EI(5), the value E1 is 16 (N·m²) or greater and 25 (N·m²) or less, the value (E2−E1) is equal to or less than 20 (N·m²), and the value EI(10) is 60 (N·m²) or greater and 90 (N·m²) or less.

3. The shaft for golf clubs according to claim 1 wherein the overall length of the shaft is equal to or greater than 43 inches.

4. The shaft for golf clubs according to claim 1 wherein the forward flex is 95 mm or greater and 120 mm or less.

5. In a golf club comprising a head, a shaft and a grip, provided that:

a position 130 mm away from the head-side end of the shaft is defined as a first position; a position 130 mm away from the grip-side end of the shaft is defined as a tenth position, and positions provided by equally dividing the length between the first position and the tenth position into nine regions are defined as from a second position to a ninth position in this order from the head side;

each flexural rigidity EI measured at ten sites of from the first position to the tenth position is defined as from EI(1) to EI(10) in this order from the head side;

each point obtained by plotting the measurement values at the positions of ten sites on an X-Y coordinate plane, in which the X-axis represents the distance (mm) to the measurement position from the head-side end and the Y-axis represents the value of flexural rigidity EI($N \cdot m^2$), is defined as from T(1) to T(10) in this order from the head side;

the formula representing a line K that passes the T(1) and the T(10) on the X-Y coordinate plane is [Y=aX+b1];

the values ($N \cdot m^2$) at the Y-intercepts on the lines that are parallel to the line K and that pass the points of from T(2) to T(9), respectively, are defined as from b2 to b9, respectively; and the minimum value among the values at the Y-intercept b2 to b9 is defined as bmin, the following definition is made, said shaft having the slope "a" of the line K being 0.04 or greater and 0.06 or less, any one of the b3, b4, b5, b6, b7 and b8 being smaller than b1, the bmin being any one of b4, b5, b6 or b7, the value (b1−bmin) being 24 ($N \cdot m^2$) or greater and 35 ($N \cdot m^2$) or less, and the value (b9−b1) being 0 or greater and 10 ($N \cdot m^2$) or less.

* * * * *

UNITED STATES PATENT AND TRADEMARK OFFICE

CERTIFICATE OF CORRECTION

PATENT NO. : 7,427,240 B2
APPLICATION NO. : 11/783227
DATED : September 23, 2008
INVENTOR(S) : Takeuchi It is certified that error appears in the above-identified patent and that said Letters Patent is hereby corrected as shown below:

IN THE SPECIFICATION:

Column 1, line 15, change "shaft" to --shafts--; and change "club" to --clubs--.

Column 1, lines 32, 35, 37, 41, change "arts" to --art--, for each occurrence.

Column 1, line 49, after "invention", change the ";" to a --,--.

Column 1, line 59, change "Provided that: each" to --Each--.

Column 8, line 23, after "Examples", change the ";" to a --,--.

Column 8, line 27, change "in the following." to --follows:--.

Column 9, line 25, change "in the following." to --follows:--.

Column 13, line 35, after "as shown in" insert --the above-noted--.

IN THE CLAIMS:

In claim 1 at Column 13, line 55, delete "provided that:".

In claim 1 at Column 13, line 57, after "position" change the ";" to a --,--.

In claim 1 at Column 14, line 45, delete "that:".

In claim 2 at Column 14, line 57, delete "provided that".

In claim 2 at Column 14, line 58, delete "and that".

In claim 3 at Column 14, line 66, after "claim 1" insert --,--.

In claim 4 at Column 15, line 1, after "claim 1" insert --,--.

In claim 5 at Column 15, line 4, delete "provided that:".

In claim 5 at Column 14, line 6, after "position" change the ";" to a --,--.

Signed and Sealed this

Twelfth Day of January, 2010

David J. Kappos

David J. Kappos
*Director of the United States Patent and Trademark Office*